United States Patent [19]

Davis et al.

[11] 4,007,557

[45] Feb. 15, 1977

[54] PIVOT HUNG POWER OPERATED DOOR AND INERTIA INSENSITIVE DISCONNECTABLE DRIVE LINKAGE THEREFOR

[75] Inventors: William R. Davis, West Simsbury; William H. Flaherty, Jr., Bristol, both of Conn.

[73] Assignee: The Stanley Works, New Britain, Conn.

[22] Filed: Mar. 3, 1975

[21] Appl. No.: 554,632

[52] U.S. Cl. ..... 49/139; 49/141; 49/326; 49/340

[51] Int. Cl.[2] ..... E05F 15/54

[58] Field of Search ..... 49/141, 139, 326, 339, 49/340, 334, 346, 345

[56] References Cited

UNITED STATES PATENTS

| | | | |
|---|---|---|---|
| 2,149,870 | 3/1939 | Roby | 49/139 |
| 3,210,067 | 10/1965 | Ferguson et al. | 49/334 X |
| 3,675,370 | 7/1972 | Catlett | 49/141 X |

*Primary Examiner*—Kenneth Downey

*Attorney, Agent, or Firm*—Prutzman, Hayes, Kalb & Chilton

[57] ABSTRACT

An inertia insensitive disconnectable drive linkage connects a power operator to a swinging door and comprises a door bracket fixed to the door and an arm operator pivoted thereto. A latch positively locks the operator arm to the bracket during normal powered swing of the door. A cam on the door frame releases the latch when the door is swung beyond the door closed position in the opposite direction of opening during emergency operation.

6 Claims, 3 Drawing Figures

PIVOT HUNG POWER OPERATED DOOR AND INERTIA INSENSITIVE DISCONNECTABLE DRIVE LINKAGE THEREFOR

The present invention relates generally to a power operated door and is more particularly concerned with a pivot hung door having a new and improved drive linkage connecting the door to a drive spindle offset from the hinge line of the door.

Automatic power operated doors that swing inwardly during normal operation are used today in many commerical establishments. These doors are driven between their normally closed and normally opened positions by power operators but must be capable of permitting manual opening of the door in an outward direction in the event of an emergency. In order to achieve this outward or reverse opening of the door, it is necessary to utilize a door installation having a bi-swing capability. Numerous commericially available powered door assemblies provide for the release of the door from the operator by a detent type disconnect mechanism such as that described in the Ferguson et al U.S. Pat. No. 3,210,067.

In door disconnect system, the force requires to open the door during emergencies must be limited to about 50 pounds at the free edge of the door so that typical building occupants may make emergency egress. In some installations, the level required may be sufficiently low, as compared with the level applied to normally open the door, that the door may be disconnected during normal operation of the door.

The recent Kalog et al, U.S. Pat. No. 3,510,984 is directed to a door having a control linkage wherein it is not necessary to disconnect the operator from the door upon reverse movement of the door under emergency conditions. However, the linkage described in the patent is a multi-link system which occupies considerable space. Additionally, the linkage system requires a special door and is not readily suited for retrofit of an existing door.

Accordingly, it is an object of the present invention to provide a center pivot hung door having a new and improved drive linkage which cannot disconnect from the door during its normal inward operation, but will readily disconnect with minimal force on the door in an outward direction during emergency operation.

Another object of this invention is to provide a drive linkage for center pivot hung doors which will accommodate emergency break-out operation and is suited for retrofit application on conventional pivot hung doors.

Still another object of the present invention is to provide a drive linkage having an adjustable break-out mechanism which will accommodate manufacturing variations and tolerances.

A further object of the present invention is to provide a drive linkage which is door inertia insensitive. Included in this object is the provision of a drive linkage which can be disconnected from the door only when the door is in its full closed position and automatically renders the control circuit for the door operator inoperative when disconnected.

A further object of the present invention is to provide an improved drive linkage which is reliable and durable yet of lightweight construction and is easily installed on a wide variety of pivot hung doors without the modification thereof.

Other objects will be in part obvious and in part pointed out in more detail hereinafter.

A better understanding of the invention will be obtained from the following detailed description and the accompanying drawings which set forth an illustrative embodiment indicative of the way in which the principles of the invention are employed.

Figure 1:
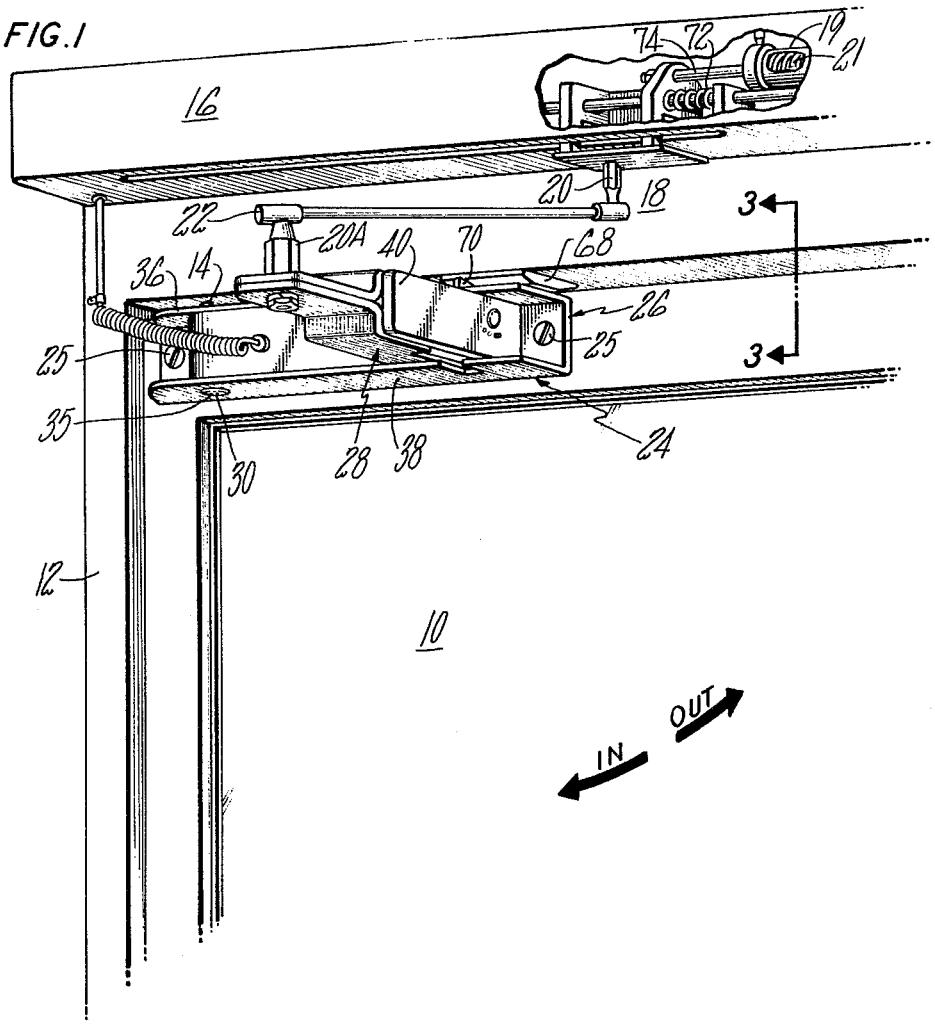
FIG. 1 is a fragmentary perspective view of a power operated pivot hung door including a drive linkage embodying the features of the present invention.

Referring now to the drawings in detail wherein like reference numerals indicate like parts throughout the several figures, a center pivot hung door 10 is shown as being mounted within a door frame 12 for bi-swinging pivotal movement about pivot 14. A suitable power operator 16 is mounted on the header 18 of the door frame 12 and includes a fluid cylinder 19 connected to drive arm 20 offset from the axis of pivot 14 of the door 10. The drive arm 20 of the power operator 16 is connected by a rod 22 having ball socket ends to a second drive arm 20A of drive linkage 24 which in turn is secured to the door 10 by fasteners 25.

In normal operation, fluid cylinder 19 is actuated to drive the drive arm 20 for reciprocable movement in a plane parallel to the header 18 causing the rod 22 to drive the drive linkage 24, and therefore, to pivot the door 10 inwardly to its open position in response to traffic therethrough. After the traffic has passed, the operator returns the door to its full closed position under the bias of spring 21. The drive linkage 24 also permits the door 10 to pivot from a fully closed position to a full outward position during an emergency as will be more fully described hereinafter.

Drive linkage 24 comprises a door bracket 26 and an operator arm 28 pivotally connected thereto by pivot pin 30. Door bracket 26 is generally U-shaped and has apertures 32 in its base portion 34 for receiving fasteners 25 to attach the drive linkage 24 to the base of a conventional door frame and apertures 35 in leg portions 36 and 38 for receiving pivot pin 30.

At the opposite end of bracket 26 is a latch plate 40 fixed, as by welding, to base portion 34 and lgs 36 and 38 of door bracket 26. Pivotally mounted to latch plate 40 by stud 42 is a cam latch 44. A spring 46, having arms 48 and 50, bias cam latch 44 in a counter-clockwise direction against a stop provided by an edge of a notch 45 in the leg 36.

Operator arm 28 is a generally L-shaped member having upper and lower plates 52, 54 respectively, which are mirror images of each other and mount arm 20A at their free end.

The upper and lower plates 52, 54 forming operator arm 28 are apertured at 35 to receive pivot pin 30 and pivotally connect operator arm 28 to door bracket 26. A cross-pin 58 secures pivot pin 30 against axial movement relative to knuckle 56 which spans the plates 52, 54.

Figure 3:
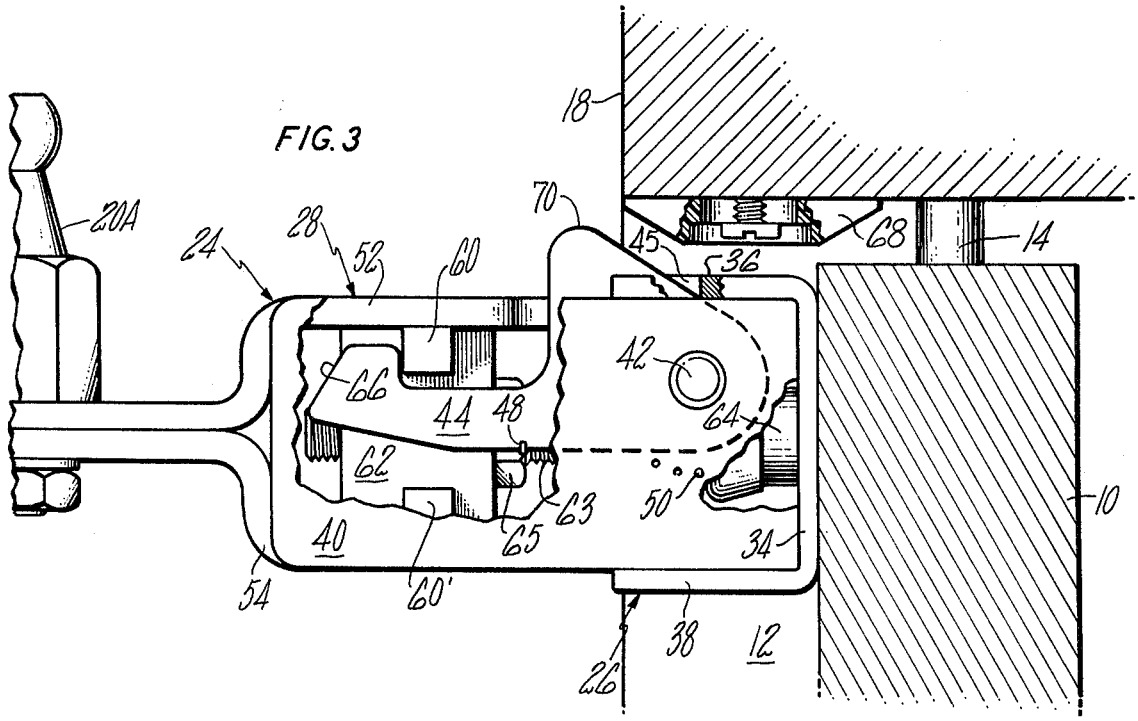
FIG. 3 is a sectional view taken along line 3—3 of FIG. 1.
Figure 2:
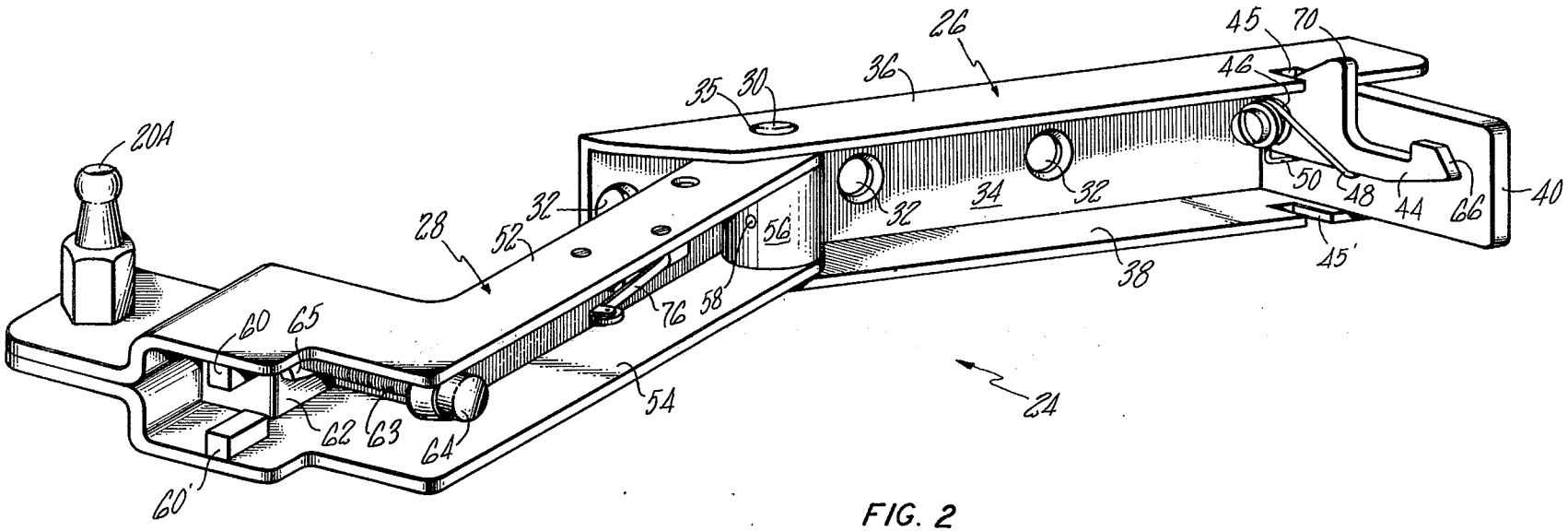
FIG. 2 is a perspective view showing the drive linkage of the present invention in its break-out position.

Fixed to the upper plate 52 and located for latching engagement (as shown in FIG. 3) with cam latch 44 is a striker bar 60. Adjacent to the striker bar 60 is a mounting block 62 which adjustably mounts a resilient bumper or cushion 64 by means of a threaded stem 63 which is locked in position by a lock nut 65.

Adjustably mounted to the underside of the header 18 is a latch release means comprising cam 68 which is aligned to contact the cam follower portion 70 of cam latch 44. When the door 10 is pivoted in an outward direction a few degrees during emergency operation, cam follower portion 70 contacts release cam 68 forcing cam latch 44 against the bias of spring 46, to unlatch from striker bar 60 thereby to release operator arm 28 from door bracket 26 so that door 10 may swing outwardly about pivot 14 independently of operator 19 to a fully opened outward direction.

It will be appreciated that as the door 10 moves in an outward direction a few degrees prior to becoming unlatched from operator 19, rod 22 will move drive arm 20 to the right as viewed in FIG. 1 so that piston rod 74 is retracted past its normal door closed position to compress spring 72. After the cam latch 44 is uncoupled from striker bar 60, spring 72 returns the piston rod 74 and operator arm 28 to their door closed positions where they are held under the opposing biases of springs 21 and 72. In this regard, spring 72 is a stiff spring having higher spring force but limited extension so that it overpowers spring 21 until spring 72 is at its full extension.

Mounted to the underside of the upper plate 52 of operator arm 28 is a switch 76 positioned to be actuated by the base portion 34 of door bracket 26. Switch 76 serves to electrically disconnect the control circuit (not shown) for fluid operator 19 when the drive linkage is unlatched during emergency outward opening thereby causing operator 16 to be inoperative.

A second striker bar 60' on operator arm 28 and another opening 45' on door bracket 26 are provided to provide an opposite hand drive linkage.

It will be appreciated that after door 10 has been unlatched to pivot in an outward direction all that need be done to relatch the door bracket 26 and operator arm 28 is to pivot the door to its closed position so that the cam follower portion 70 of cam latch 44 engages cam 68 to depress nose 66 of cam latch 44 until cam latch 44 latches with striker bar 60 under the bias of spring 46 where it is biased against striker bar 60 under the bias of cushion 64 to secure door bracket 26 and operator arm 28 snugly together without clearance.

As will be apparent to persons skilled in the art, various modifications, adaptations and variations of the foregoing specific disclosure can be made without departing from the teachings of the present invention.

We claim:

1. A power operated pivot hung door suited for biswinging movement, a power operator for powering the door through a door opening and closing cycle in one direction from the door closed position, and an inertia insensitive disconnectable drive linkage for connecting the operator to the door, said drive linkage comprising a door bracket fixed to the door and an operator arm pivotally mounted thereto, said operator arm providing a drive arm offset from the pivot axis of the door, means operatively connecting said drive arm to said power operator, a latch for positively locking said operator arm to said bracket during the normal powered operation of the door regardless of the forces imposed thereon, and latch release means automatically operable to release said operator arm for pivotal movement relative to said bracket only when the door is swung beyond said door closed position in the direction opposite to said one direction for emergency operation.

2. The device of claim 1 wherein said latch release means is a cam mounted on the door frame to engage the latch and release it as the door is moved from the door the door closed position during emergency operation.

3. The device of claim 1 wherein a switch for controlling the actuation of said power operator is mounted by said door bracket and is actuated by the relative pivotal movement of said operator arm during emergency operation to render the operator inoperative during emergency operation of the door.

4. The device of claim 2 wherein a striker bar is provided on said operator arm from engagement by the latch to lock the bracket and the operator arm against relative pivotal movement and the latch is provided with a camming surface engageable with said latch release cam when the door is returned to its normal position following emergency operation thereof to automatically relatch the door for normal powered operation.

5. The device of claim 2 wherein an overtravel spring is provided to hold the door in its closed position and accommodate the overtravel of the door past its door closed position so that the latch may engage the latch release cam to release the door from the power operator during emergency operation.

6. An inertia insensitive disconnectable drive linkage for a pivot hung door suited for positively latching the door to a power operator during normal powered operation in one direction of door swing from the door closed position while accommodating emergency break-out operation in the opposite direction of door movement from the door closed position when force is applied to swing the door in said opposite direction from the door closed position, said drive linkage including a bracket fixed to the door, an operator arm mounted for pivotal movement with respect to the bracket, and a latch pivotally mounted on the bracket and engageable with a striker bar mounted on the operator arm to positively lock the same together during normal powered operation of the door regardless of the forces imposed thereon, and a latch release means engageable by the latch to automatically uncouple the bracket from the operator arm only when the door is swung beyond said door closed position in the direction opposite said one direction during emergency operation.

* * * * *

UNITED STATES PATENT AND TRADEMARK OFFICE

CERTIFICATE OF CORRECTION

PATENT NO. : 4,007,557

DATED : February 15, 1977

INVENTOR(S) : William R. Davis & William H. Flaherty, Jr.

It is certified that error appears in the above–identified patent and that said Letters Patent are hereby corrected as shown below:

Column 1, line 25, cancel "system" and substitute therefor --systems--.

Column 2, line 47, cancel "lgs" and substitute therefor --legs--.

Column 2, line 55, insert --drive-- after "mount".

Column 4, line 23, cancel "from" and substitute therefor --for--.

Signed and Sealed this

Twelfth Day of April 1977

[SEAL]

*Attest:*

RUTH C. MASON
*Attesting Officer*

C. MARSHALL DANN
*Commissioner of Patents and Trademarks*